US006558063B2

(12) United States Patent
Ho

(10) Patent No.: US 6,558,063 B2
(45) Date of Patent: May 6, 2003

(54) DOCUMENT HOLDER

(76) Inventor: Chin-Lien Ho, No. 36, Lo-Yang Rd., Hsi-Tun Dist., Taichung City (TW)

( * ) Notice: Subject to any disclaimer, the term of this patent is extended or adjusted under 35 U.S.C. 154(b) by 0 days.

(21) Appl. No.: 09/928,021

(22) Filed: Aug. 10, 2001

(65) Prior Publication Data

US 2003/0029762 A1 Feb. 13, 2003

(51) Int. Cl.[7] ..... B42F 3/00

(52) U.S. Cl. ..... 402/73; 206/425; 283/36; 402/70; 281/45

(58) Field of Search ..... 281/15.1, 21.1, 281/29, 31, 45, 51; 402/70, 73, 4; 206/425; 283/36–42

(56) References Cited

U.S. PATENT DOCUMENTS 4,262,838 A * 4/1981 Mackenzie ..... 229/72
4,269,347 A * 5/1981 Cavan, Jr. ..... 229/33
D359,310 S * 6/1995 Su ..... D19/90
6,223,897 B1 * 5/2001 Bordes ..... 206/425

* cited by examiner

*Primary Examiner*—Willmon Fridie, Jr.
(74) *Attorney, Agent, or Firm*—Akin Gump Strauss Hauer & Feld, L.L.P.

(57) ABSTRACT

A document holder includes a flat base part, front and rear wall parts, a pair of lateral wall parts, and a cover part. Each of the front and rear wall parts extends upwardly from a respective one of front and rear edges of the base part. The lateral wall parts extend between the front and rear wall parts, and cooperate with the latter to confine a document holding space with an open top. The cover part is hinged to the rear wall part, is movable so as to cover and uncover the open top of the document holding space, and is formed with a window section that permits viewing into the document holding space when the latter is covered by the cover part.

6 Claims, 5 Drawing Sheets

DOCUMENT HOLDER

BACKGROUND OF THE INVENTION

1. Field of the Invention

The invention relates to a document holder, more particularly to a document holder that facilitates viewing of documents therein.

2. Description of the Related Art

Referring to FIGS. 1 and 2, a conventional document holder 1 is shown to comprise a flat base part 112, front and rear wall parts 111, 113, a pair of lateral wall parts 115, and a cover part 114. The front and rear edges 1121, 1122 of the base part 112 extend in a longitudinal direction, and are spaced apart in a transverse direction transverse to the longitudinal direction. Each of the front and rear wall parts 111, 113 extends upwardly from a respective one of the front and rear edges 1121, 1122 of the base part 112. The lateral wall parts 115 are spaced apart in the longitudinal direction, and are formed with a plurality of pleats 1153. Each of the lateral wall parts 115 further extends in the transverse direction, is connected at one end 1152 to the front wall part 111, and cooperates with the front and rear wall parts 111, 113 to confine a document holding space 116 with an open top. A plurality of partition plates 1156 extend in the longitudinal direction, and have opposite ends connected respectively to the lateral wall parts 115. The partition plates 1156 cooperate with the lateral wall parts 115 to divide the document holding space 116 into a plurality of volume variable spaces. The cover part 114 is hinged to a top edge 1131 of the rear wall part 113, and is movable between a closed position, where the cover part 114 covers the open top of the document holding space 116, as best illustrated in FIG. 2, and an open position, where the cover part 114 uncovers the open top of the document holding space 116, as best shown in FIG. 1. The front wall part 111 and the cover part 114 are provided with interlocking male and female fasteners 1141, 1111 for retaining releasably the cover part 114 at the closed position.

In use, the male fastener 1141 on the cover part 114 is pulled apart from the female fastener 1111 on the front wall part 111 to permit movement of the cover part 114 to the open position. The documents are then put into the volume variable spaces of the document holding space 116. After moving the cover part 114 to the closed position, the male fastener 1141 on the cover part 114 is brought to engage the female fastener 1111 on the front wall part 111.

It is noted that the conventional document holder 1 has no window section to permit viewing of the documents inside when the cover part 114 is at the closed position, thereby resulting in inconvenience. In addition, although the conventional document holder 1 is provided with a wide document holding space 116, no space is allocated for receiving accessories, such as pens, coins, cellular phones, etc.

SUMMARY OF THE INVENTION

Therefore, the main object of the present invention is to provide a document holder that is capable of overcoming the aforementioned drawbacks of the prior art.

Accordingly, a document holder of this invention comprises a flat base part, front and rear wall parts, a pair of lateral wall parts, and a cover part. The flat base part has a front edge, a rear edge, a bottom surface, and a top surface opposite to the bottom surface. The front and rear edges extend in a longitudinal direction, and are spaced apart in a transverse direction transverse to the longitudinal direction. Each of the front and rear wall parts extends upwardly from a respective one of the front and rear edges of the base part. The lateral wall parts are spaced apart in the longitudinal direction. Each of the lateral wall parts extends in the transverse direction, is connected to at least one of the front and rear wall parts, and cooperates with the front and rear wall parts to confine a document holding space with an open top. The cover part is hinged to a top edge of the rear wall part, is movable between a closed position and an open position, and is formed with a window section. In the closed position, the cover part covers the open top of the document holding space. In the open position, the cover part uncovers the open top of the document holding space. The window section is registered with the open top of the document holding space and permits viewing into the document holding space when the cover part is disposed at the closed position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
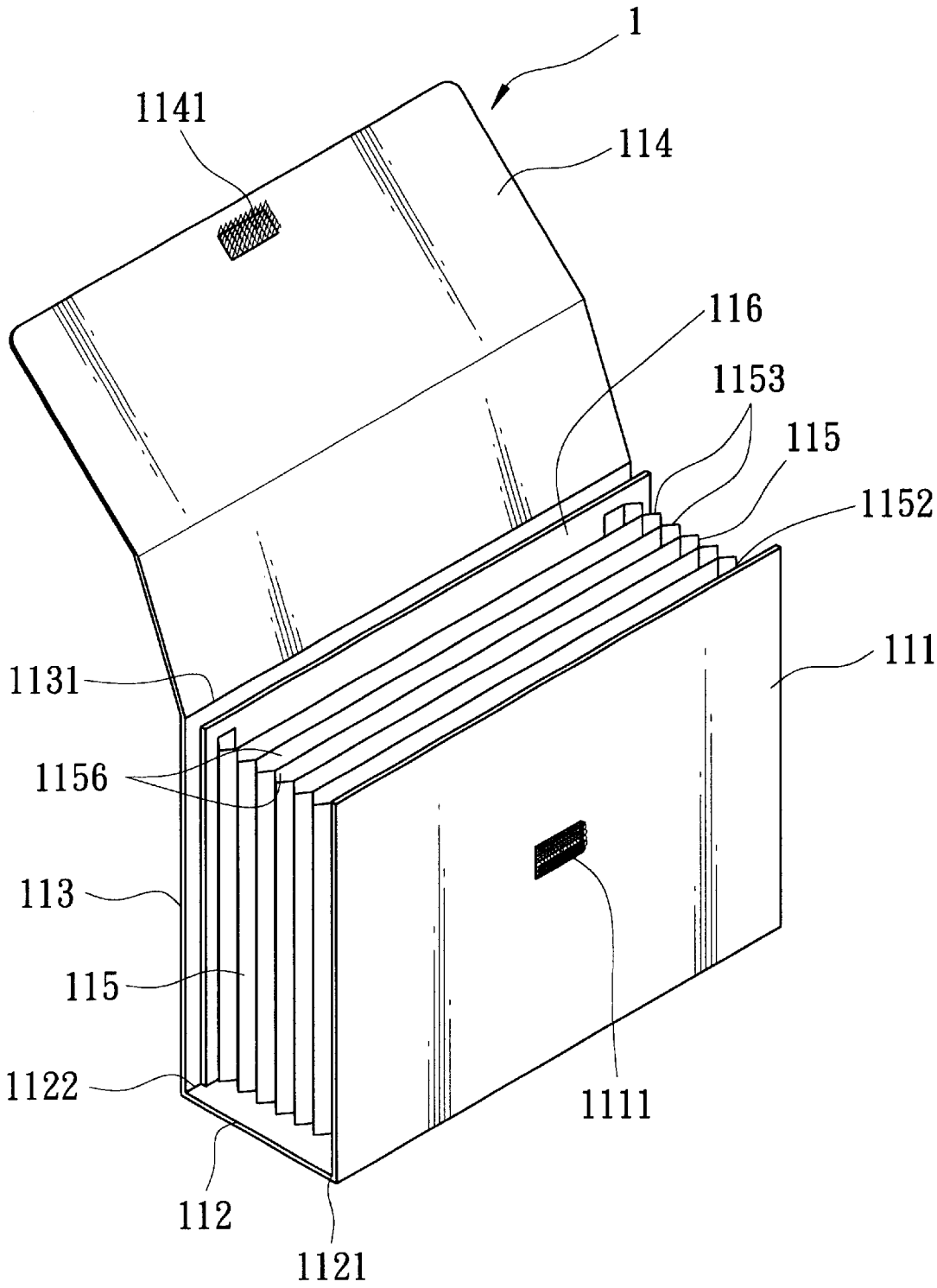
FIG. 1 PRIOR ART
FIG. 1 is a perspective view of the conventional document holder.
Figure 2:
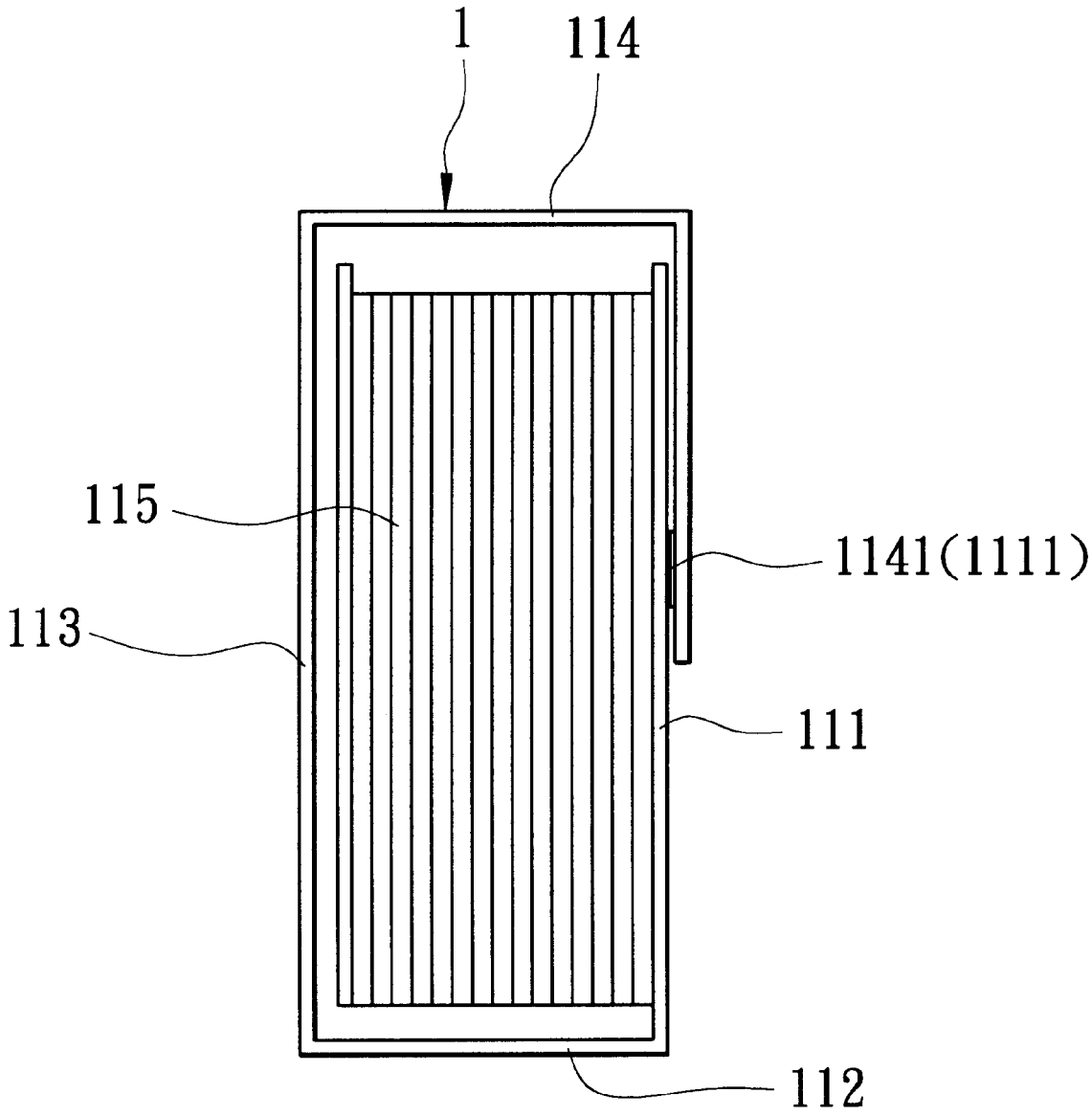
FIG. 2 PRIOR ART
FIG. 2 is a schematic side view of the document holder of FIG. 1.
Figure 3:
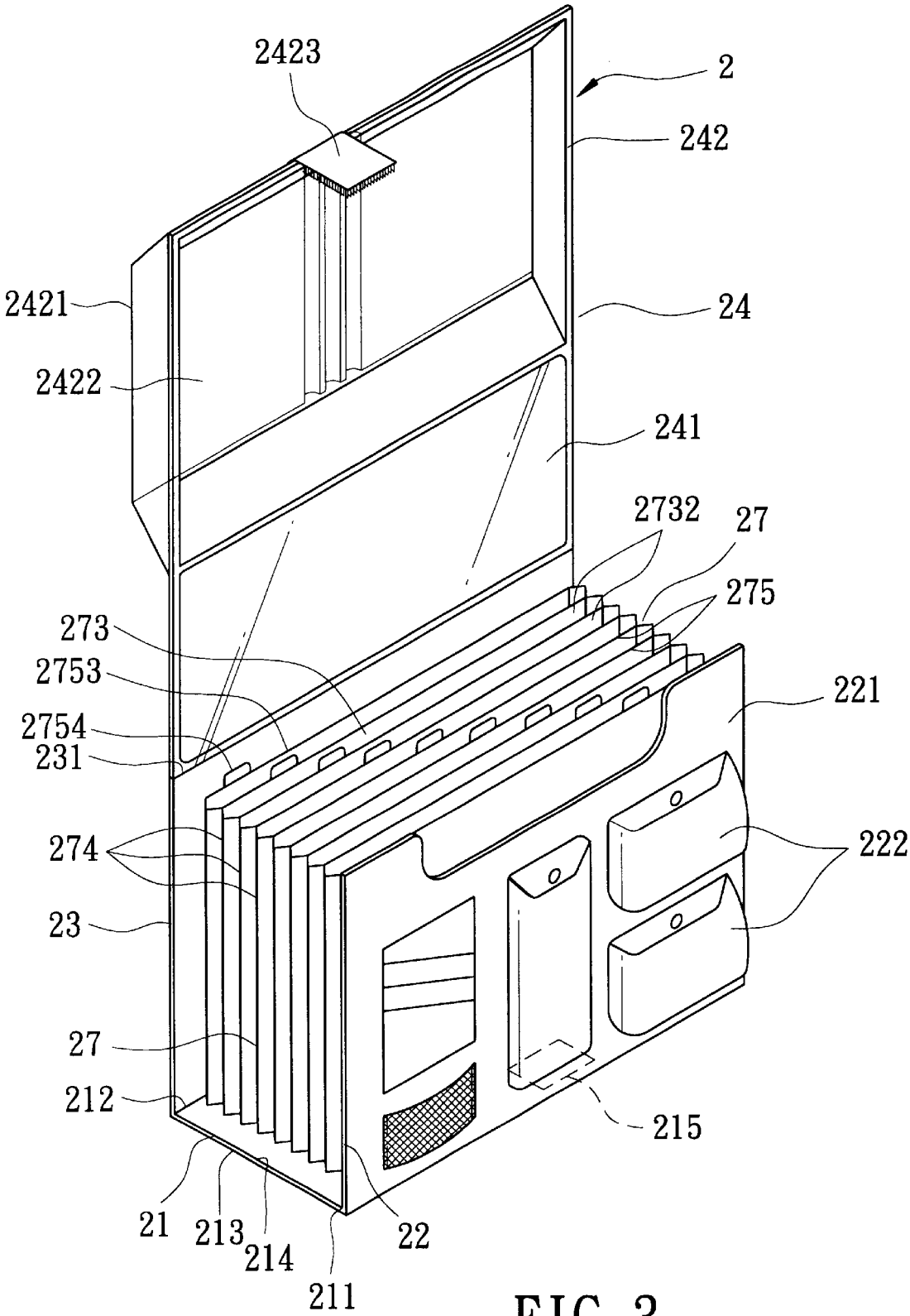
FIG. 3 is a perspective view of the preferred embodiment of a document holder according to the present invention.
Figure 4:
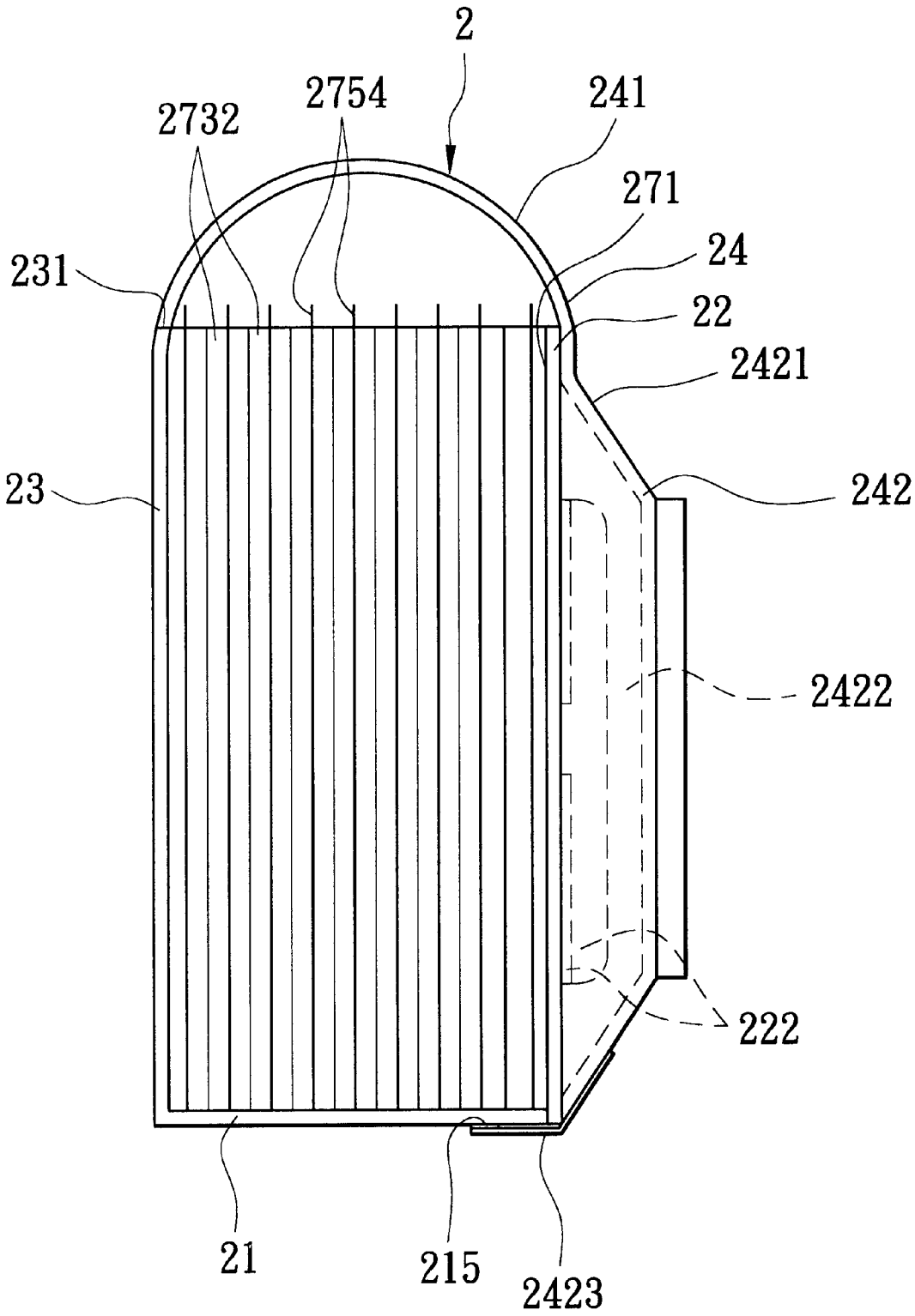
FIG. 4 is a schematic side view of the document holder of FIG. 3.
Figure 5:
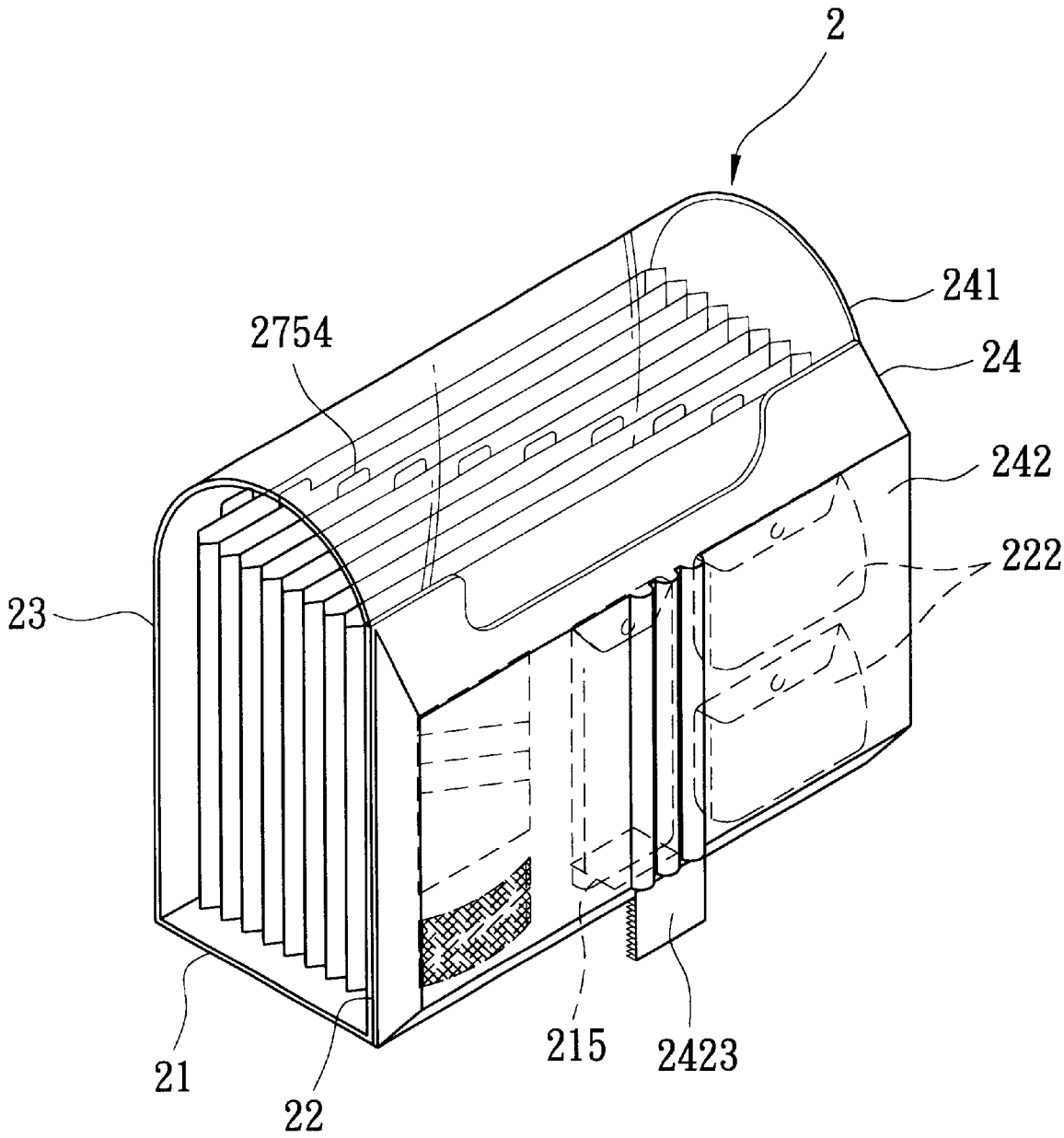
FIG. 5 is another perspective view of the document holder of FIG. 3, but with a cover part thereof in a closed state.

Referring to FIGS. 3 to 5, the preferred embodiment of a document holder 2 according to the present invention is shown to comprise a flat base part 21, front and rear wall parts 22, 23, a pair of lateral wall parts 27, and a cover part 24. The flat base part 21 has a front edge 211, a rear edge 212, a bottom surface 213, and a top surface 214 opposite to the bottom surface 213. The front and rear edges 211, 212 extend in a longitudinal direction, and are spaced apart in a transverse direction transverse to the longitudinal direction.

Each of the front and rear wall parts 22, 23 extends upwardly from a respective one of the front and rear edges 211, 212 of the base part 21. The front wall part 22 has an outer surface 221 opposite to the rear wall part 23. The rear wall part 23 has a top edge 231.

The lateral wall parts 27 are spaced apart in the longitudinal direction. Each of the lateral wall parts 27 further extends in the transverse direction, is connected at one end 271 to the front wall part 22, is formed with a plurality of pleats 274, and cooperates with the front and rear wall parts 22, 23 to confine a document holding space 273 with an open top. A plurality of partition plates 275 extend in the longitudinal direction and have opposite ends connected respectively to the lateral wall parts 27. The partition plates 275 cooperate with the lateral wall parts 27 to divide the document holding space 273 into a plurality of volume variable spaces 2732. Moreover, each of the partition plates 275 has a top edge 2753 formed with a label tab 2754.

The cover part 24 is hinged to the top edge 231 of the rear wall part 23, is movable between a closed position and an open position, and is formed with a window section 241. In the closed position, the cover part 24 covers the open top of the document holding space 273. In the open position, the cover part 24 uncovers the open top of the document holding space 273. The window section 241, in this embodiment, is transparent and is made from a plastic material, such as polypropylene. The window section 241 is registered with the open top of the document holding space 273 and permits viewing into the document holding space 273 when the cover part 24 is disposed at the closed position. The label tabs 2754 on the top edges 2753 of the partition plates 275 are visible from an exterior of the document holder 2 via the window section 241 when the cover part 24 is disposed at the closed position, as best illustrated in FIG. 5. The cover part 24 further has a front cover section 242 that extends from the window section 241. The front cover section 242 has an outer surface 2421 and a recessed inner surface 2422 that is opposite to the outer surface 2421, and that is disposed adjacent to the outer surface 221 of the front wall part 22 when the cover part 24 is at the closed position. The front cover section 242 and the bottom surface 213 of the base part 21 are provided with interlocking male and female fasteners 2423, 215 for retaining releasably the cover part 24 at the closed position. The outer surface 2421 of the front wall part 22 is further provided with a number of accessory pouches 222 that extend into the recessed inner surface 2422 of the front cover section 242 when the cover part 24 is at the closed position, as best illustrated in FIG. 4. The accessory pouches 222 are configured to receive pens, cards, coins, cellular phones, etc.

The preferred embodiment can be used in a manner substantially similar to that of the conventional document holder 1. However, in the present invention, there is no need for the user to open the cover part 24 every time a document is to be retrieved. The user only has to look at the label tabs 2754 via the transparent window section 241 of the cover part 24 to know what is inside the document holder 2, and opens the document holder 2 only if necessary.

The accessory pouches 222 extend into the recessed inner surface 2422 of the front cover section 242 when the cover part 24 is at the closed position. As such, the accessories in the accessory pouches 222 are not flattened by the front cover section 242. In addition, because the accessory pouches 222 are disposed externally of the document holding space 273, the presence of the accessory pouches 222 does not affect the capacity of the document holding space 273.

Therefore, the document holder 2 of the present invention does not only have a wide document holding space 273, but is also provided with a transparent window section 241 and label tabs 2754 to facilitate retrieval of documents, and a number of accessory pouches 222 to receive pens, cards, coins, cellular phones, etc.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A document holder comprising:

a flat base part having front and rear edges that extend in a longitudinal direction and that are spaced apart in a transverse direction transverse to the longitudinal direction, a bottom surface, and a top surface opposite to said bottom surface;

front and rear wall parts, each of which extends upwardly from a respective one of said front and rear edges of said base part, said front wall part having an outer surface opposite to said rear wall part, said rear wall part having a top edge;

a pair of lateral wall parts spaced apart in the longitudinal direction, each of said lateral wall parts extending in the transverse direction and being connected to at least one of said front and rear wall parts, said lateral wall parts cooperating with said front and rear wall parts to confine a document holding space with an open top; and a cover part hinged to said top edge of said rear wall part and movable between a closed position, where said cover part covers said open top of said document holding space, and an open position, where said cover part uncovers said open top of said document holding space;

wherein said cover part is formed with a window section that is registered with said open top of said document holding space and that permits viewing into said document holding space when said cover part is disposed at said closed position, and has a front cover section that extends from said window section and that is disposed adjacent to said outer surface of said front wall part when said cover part is at said closed position, said front cover section having an outer surface and a recessed inner surface opposite to said outer surface and disposed adjacent to said outer surface of said front wall part when said cover part is at said closed position;

wherein said outer surface of said front wall part is provided with at least one accessory pouch that extends into said recessed inner surface of said front cover section when said cover part is at said closed position.

2. The document holder as claimed in claim 1, wherein each of said lateral wall parts is formed with a plurality of pleats, said document holder further comprising a plurality of partition plates that extend in the longitudinal direction and that have opposite ends connected respectively to said lateral wall parts, said partition plates cooperating with said lateral wall parts to divide said document holding space into a plurality of volume variable spaces, each of said partition plates having a top edge formed with a label tab that is visible from an exterior of said document holder via said window section when said cover part is disposed at said closed position.

3. The document holder as claimed in claim 1, wherein said front cover section and said bottom surface of said base part are provided with interlocking male and female fasteners for retaining releasably said cover part at said closed position.

4. The document holder as claimed in claim 1, wherein said window section of said cover part is made from a transparent material.

5. The document holder as claimed in claim 4, wherein said transparent material is a plastic material.

6. The document holder as claimed in claim 5, wherein said plastic material is polypropylene.

* * * * *